US005597360A

United States Patent [19]

Freedenberg

[11] Patent Number: 5,597,360

[45] Date of Patent: Jan. 28, 1997

[54] CUE GAME TRAINING APPARATUS

[76] Inventor: Philip J. Freedenberg, 1443 McLean Mews Ct., McLean, Va. 22101

[21] Appl. No.: 385,879

[22] Filed: Feb. 9, 1995

[51] Int. Cl.[6] ..... A63B 37/00

[52] U.S. Cl. ..... 473/2

[58] Field of Search ..... 473/2

[56] References Cited

U.S. PATENT DOCUMENTS

| | | | |
|---|---|---|---|
| D. 312,290 | 11/1990 | Rodriquez . | |
| D. 316,133 | 4/1991 | Weiss, Jr. . | |
| 3,411,779 | 11/1968 | McGowan | 473/2 |
| 3,463,593 | 8/1969 | Horan . | |
| 3,843,120 | 10/1974 | Ricci . | |
| 3,947,026 | 3/1976 | Scoutten . | |
| 4,151,990 | 5/1979 | Josenhans . | |
| 4,178,694 | 12/1979 | Bonney | 473/2 |
| 4,268,033 | 5/1981 | Fontaine . | |
| 4,337,943 | 7/1982 | Stewart . | |
| 5,338,262 | 8/1994 | Hayes . | |
| 5,401,215 | 3/1995 | Pfost | 473/2 |

FOREIGN PATENT DOCUMENTS

| | | | |
|---|---|---|---|
| 26076 | 5/1913 | United Kingdom | 473/2 |
| 323795 | 1/1930 | United Kingdom | 473/2 |
| 1548354 | 7/1979 | United Kingdom . | |
| 2152390 | 8/1985 | United Kingdom | 473/2 |
| 2187647 | 9/1987 | United Kingdom | 473/2 |
| 2228205 | 8/1990 | United Kingdom . | |
| 2238481 | 6/1991 | United Kingdom . | |

OTHER PUBLICATIONS

"The Science Pocket Billiards", by Jack H. Koehler, Sportology Publications, Laguna Hills, CA, pp. 57 and 142.

*Primary Examiner*—Theatrice Brown

*Attorney, Agent, or Firm*—Oblon, Spivak, McClelland, Maier & Neustadt, P.C.

[57] ABSTRACT

The present invention relates to a hand-held mechanical analog computer mechanism which is utilized to aid players of billiards and other cue games. The mechanism calculates and displays useful information on aiming, shooting and cue ball deflection. The invention includes a fixed base display as well as a movable dial which is mounted on the fixed base so as to be rotatable with respect to the fixed base in parallel planes around a common axis. Movement of a dial on the mechanism is controlled by a mechanical linking mechanism and rotational positions and angular relationships with respect to scales appearing on the fixed base and movable dial are measured relative to the fixed base.

19 Claims, 6 Drawing Sheets

CUE GAME TRAINING APPARATUS

BACKGROUND OF THE INVENTION

1. Field of the Invention

The present invention relates to a mechanical analog computer mechanism which is to be utilized as an aid for training players of pool, billiards, snooker and other cue games. The embodiment of the present invention is a hand-held mechanism which displays useful information regarding aiming, shooting, and cue ball deflection.

It is generally recognized that success in cue games, including billiards, pool, snooker, and the like, depends upon two principal factors: (1) the player's ability to send an object ball in a desired direction after it is struck by the cue ball, which the player has propelled by means of a cue; and (2) the player's ability to direct the cue ball to a desired region of the playing table surface after its collision with the object ball. The first factor generally yields a tactical advantage (e.g., scoring a point by pocketing a ball in pool) and permits the player to continue his inning. The second factor generally yields a strategic advantage, typically by positioning the cue ball so as to facilitate the player's attempt on a subsequent object ball. The present invention simultaneously addresses both of these factors. In particular, it provides the player or student with critical information on how to align and aim the cue ball with respect to the object ball so as to achieve the desired movement of both the object ball and the cue ball.

2. Discussion of the Background

Conventional cue game training devices comprise cue ball aim indicators and scale displays which can be utilized to indicate an aiming line for the cue ball with respect to an object ball. However, conventional devices do not provide for a hand-held mechanism, which can simultaneously and automatically display various information such as the cue ball's cut angle, the cue ball's deflection angle, the eclipse of the object ball by the cue ball, and the amount of "english" (or sidespin) that is required to negate the effect of collision induced english on a contemplated shot.

SUMMARY OF THE INVENTION

Accordingly, an object of the present invention is to provide for a hand-held mechanical analog computer mechanism which can calculate and display useful information on aiming, shooting and cue ball deflection simultaneously and automatically.

The mechanical analog computer of the present invention comprises, among other items, means for aligning a fixed arrow with an object ball so as to set and display the object ball's intended direction of travel; means for setting an aiming line of a cue ball based on a position of the object ball with respect to a cue ball; means for determining a cut angle between the object ball's intended direction of travel and the aiming line; and means for determining a carom angle of the cue ball after it hits the object ball. The carom angle is defined between the aiming line and a direction in which the cue ball travels after it hits the object ball.

The present invention also provides for a cue game training apparatus which comprises a fixed base and a movable dial rotatably mounted to each other so as to rotate relative to one another around a common axis in parallel planes; and linking means mounted between the fixed base and the movable dial, the linking means comprising a pointer such that a movement of the movable dial with respect to the fixed base causes the linking means to control a movement of the pointer relative to the fixed base and the movable dial.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein.

DESCRIPTION OF THE PREFERRED EMBODIMENT

Figure 1:
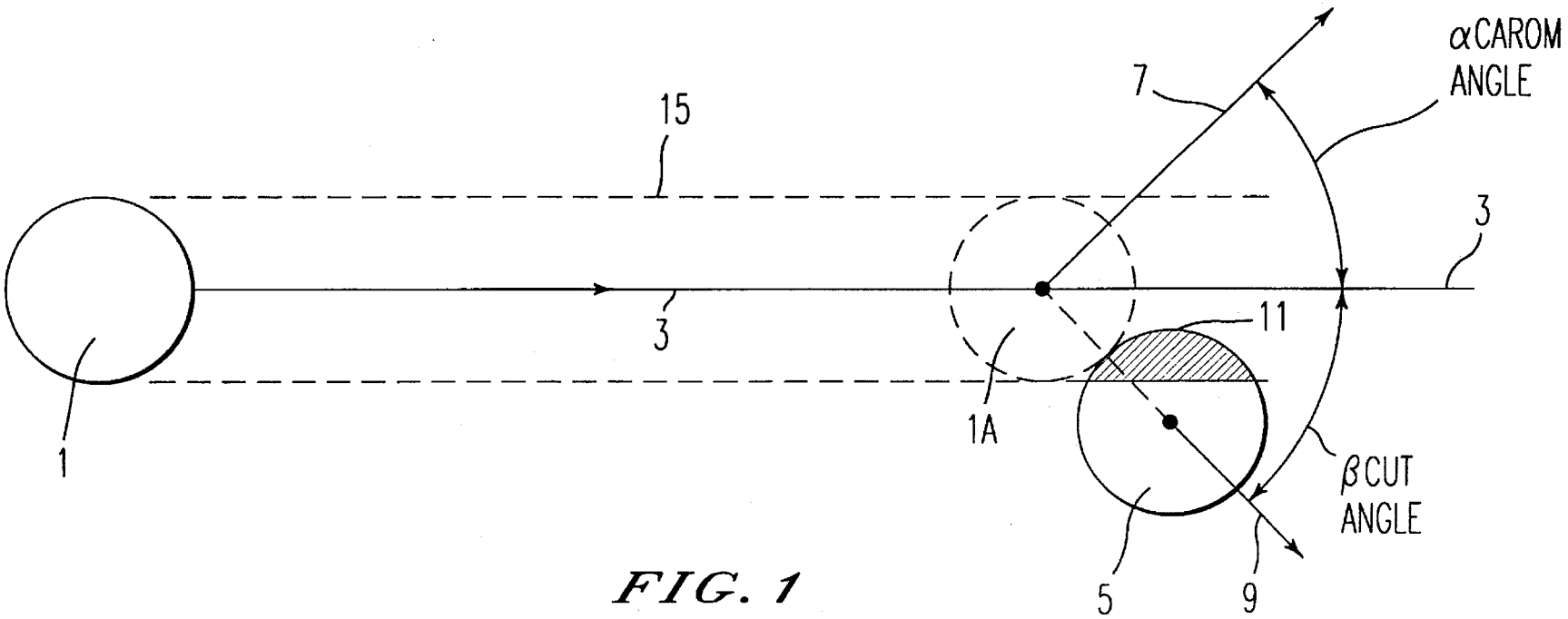
FIG. 1 schematically illustrates the relationship between a cue ball, an object ball and relative angles with respect to the directions of the cue ball and object ball.

Referring now to the drawings, wherein like reference numerals designate identical or corresponding parts throughout the several views, and more particularly to FIG. 1 thereof, FIG. 1 is a schematic illustration for explaining the angular relationships between the cue ball and object ball which are applied in the present invention by showing from above the table one example of the results when a cue ball strikes an object ball. In FIG. 1, the cue ball is identified by reference numeral 1. After the cue ball travels in the direction indicated by the line 3 (aiming line) it will strike the object ball 5. The cue ball 1 striking the object ball 5 is illustrated in dash lines by the reference numeral 1A. After the cue ball 1 strikes the object ball 5, the cue ball will carom in the direction illustrated by arrow 7, and the object ball 5 will travel in the direction of the arrow 9. The carom angle $\alpha$ of the cue ball after it hits the object ball is defined between the arrow 7 and the line 3. The cut angle $\beta$ as also illustrated in FIG. 1 is defined between the arrow 9 and the line 3. The amount that the object ball 5 is eclipsed by the cue ball 1 is defined by the shaded section 11 on the object ball 5. As shown in FIG. 1, dash lines 15 extend from the periphery of the cue ball 1 so as to define the fractional amount of the eclipse 11 of the object ball 5 by the cue ball 1.

Figure 2:
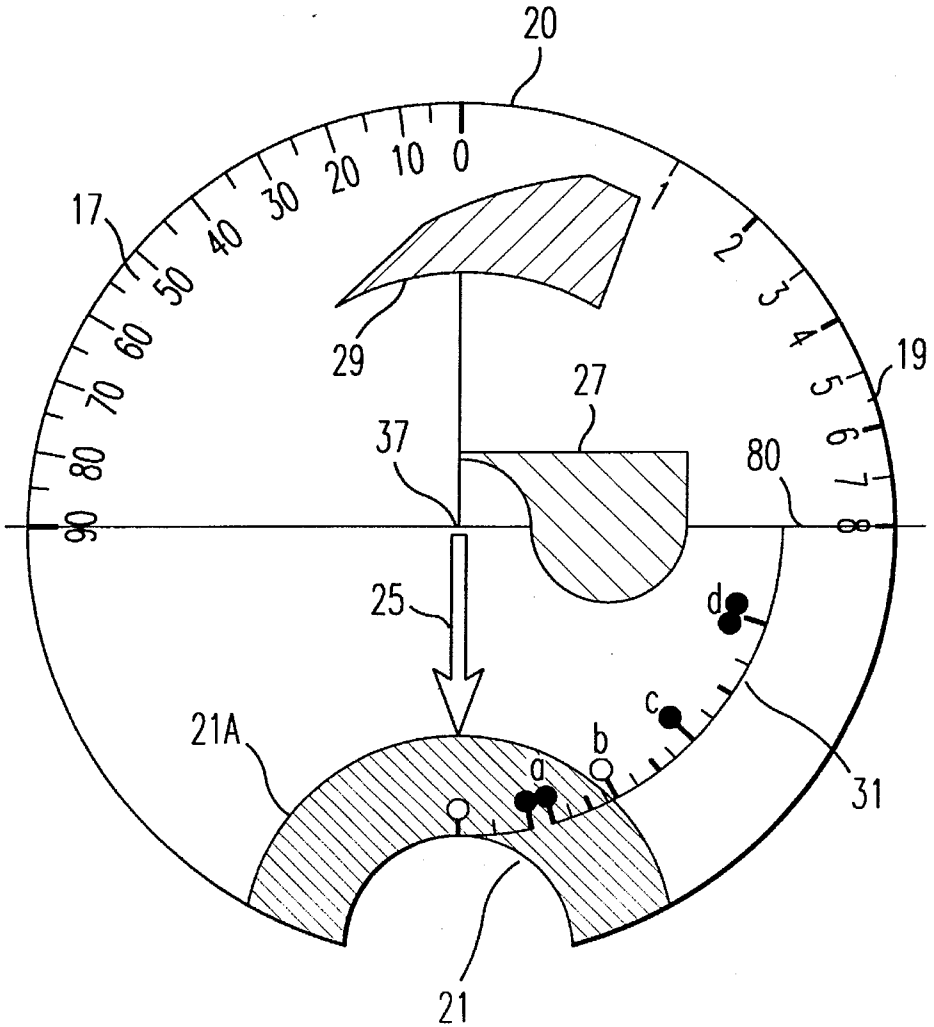
FIG. 2 illustrates a fixed base which makes up part of the apparatus of the present invention.

FIG. 2 illustrates a fixed base 20 which can be utilized with the training device of the present invention. The fixed base 20 includes a semicircular cut-out portion 21 which can be placed on the table under an object ball for setting up a shot. As further illustrated in FIG. 2, the fixed base 20 includes an arrow 25 which displays an intended direction of travel of the object ball after the cut-out portion 21 is placed under the object ball. The fixed base 20 further includes a cut-angle scale 17 which is utilized to display a cut angle between the object ball's intended direction of travel 25 and an aiming line of a cue ball which will be explained later. The fixed base 20 further includes a scale 19 and a shaped dark portion 27 which are utilized alone or in combination to determine a fraction of the object ball that is eclipsed by the cue ball.

As further illustrated in FIG. 2, the fixed base 20 includes a scale 31 which can be utilized to determine an aim point of a center of the cue ball with respect to an edge of the object ball in units of tip widths of a cue stick. (By convention, each tip width equals one-half inch.) Each major measurement division between the points, from a to b, from b to c and from c to d of the scale 31, represents a tip width of a cue stick.

Additionally, the fixed base 20 includes a shaped dark portion 29 which is utilized to determine an amount of english needed to compensate for a collision induced english between the cue ball and the object ball.

It is noted that the fixed base 20 can be manufactured of a transparent material so as to easily display and determine the above information provided by the base.

Figure 3:
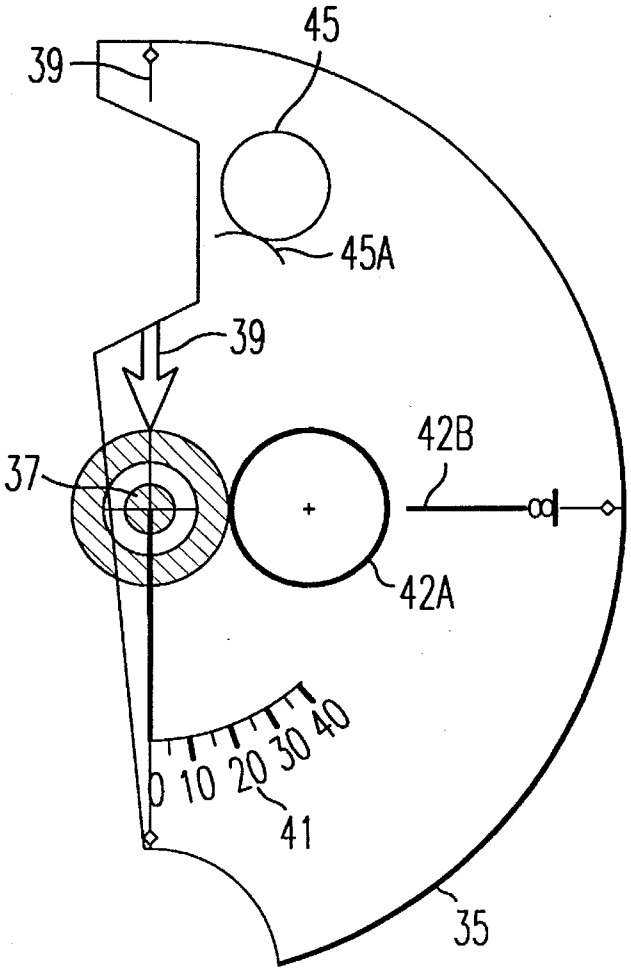
FIG. 3 illustrates a movable dial which makes up part of the apparatus of the present invention.
Figure 5:
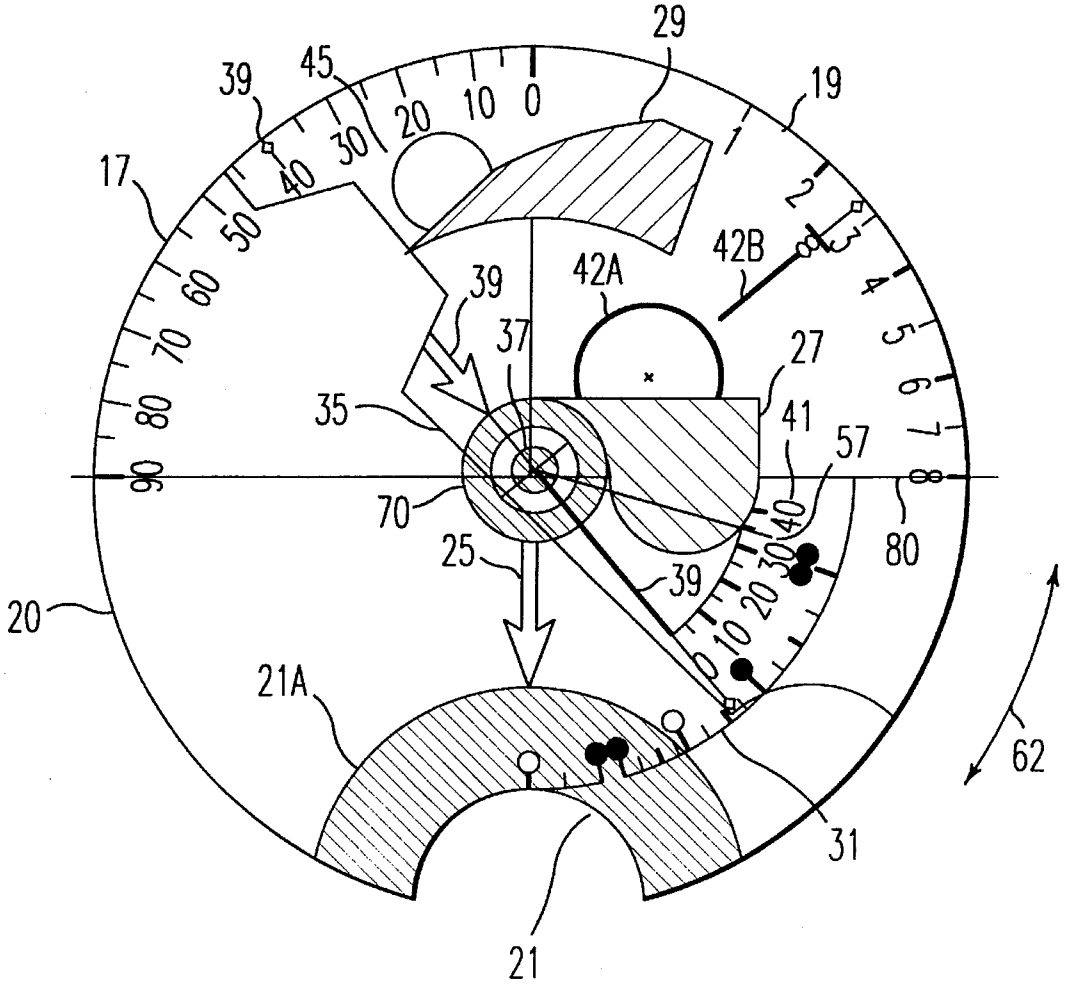
FIG. 5 illustrates the movable dial mounted on the fixed base.
Figure 6A:
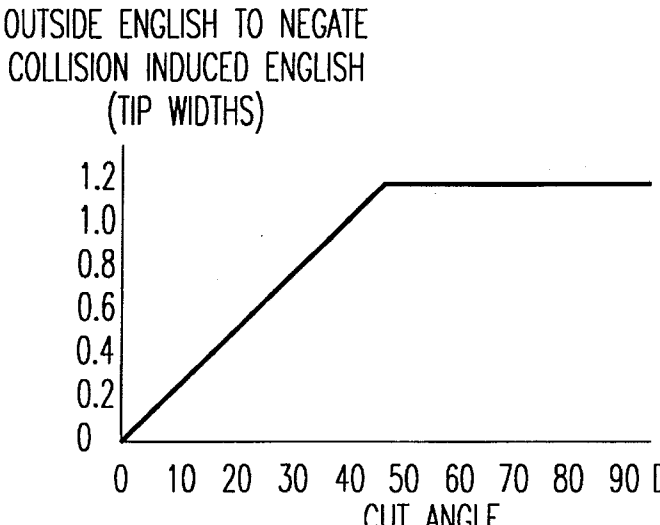
FIG. 6 illustrates mathematical functional relationships applicable to the device of the present invention.
Figure 6B:
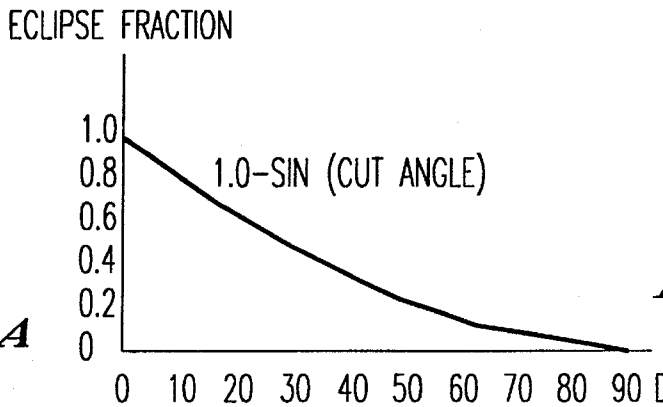
Figure 6C:
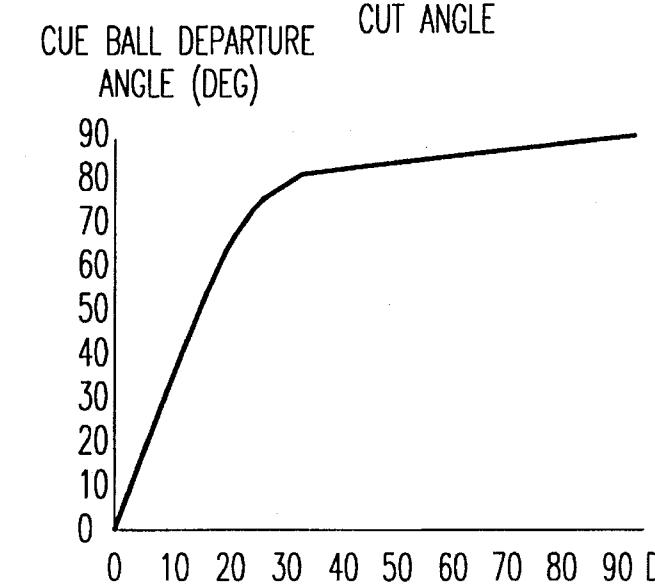
Figure 6D:
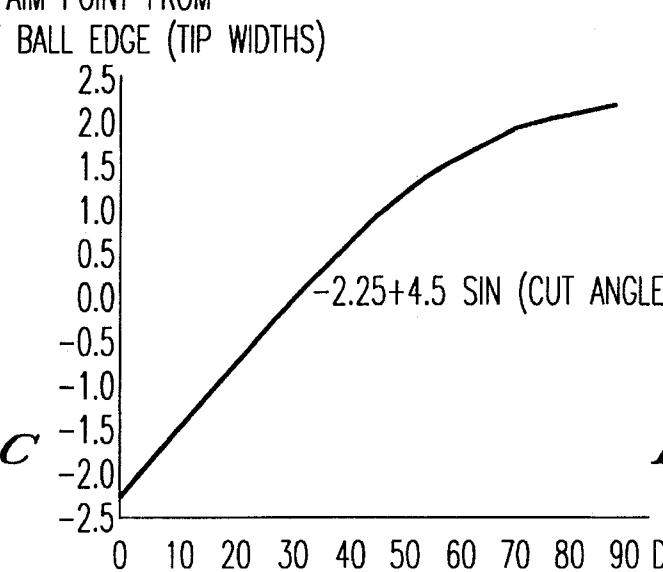

FIG. 3 illustrates a movable dial 35 which is rotatably mounted on the fixed base 20 of FIG. 2 in the manner illustrated in FIG. 5 to make up the training device of the present invention. That is, the movable dial 35 is mounted on the fixed base 20 at a common axis 37 so as to permit the movable dial 35 to rotate relative to the fixed base 20 around the common axis 37 in parallel planes. The movable dial 35, like the fixed base 20, can be transparent so as to permit easy viewing of the scales on both the movable dial 35 and the fixed base 20. The movable dial 35 includes an aiming line 39, a scale 41 which is utilized to determine a carom angle of the cue ball after it deflects off the object ball, and a circular outline 42A and scale line 42B which are utilized in combination with the scale 19 and the shaped dark portion 27 of the fixed base 20, respectively, to determine the fraction of the object ball that is eclipsed by the cue ball. The movable dial 35 further includes a circular outline 45 and semi-circular portion 45A which are utilized in combination with the shaped dark portion 29 of the fixed base 20 to determine the amount of needed english.

Figure 4:
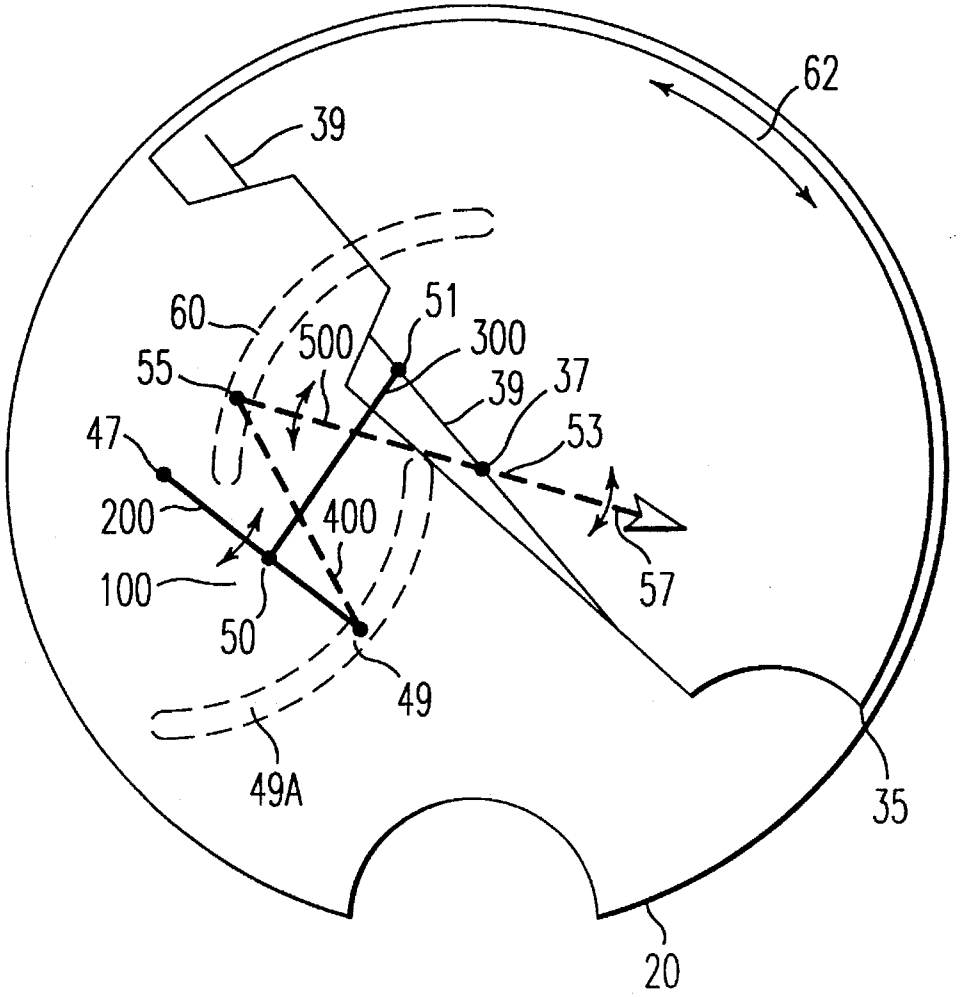
FIG. 4 illustrates an example of a linking means which can be mounted between the fixed base and movable dial of the present invention.

FIG. 4 illustrates an example of a multibar linkage 100 which can be positioned in parallel between the fixed base 20 and movable dial 35 of the present invention when the movable dial 35 is rotatably mounted on the fixed base 20. In order to clearly illustrate the multibar linkage 100 in FIG. 4, the fixed base 20 and movable dial 35 are shown without the scales. As illustrated in FIG. 4, the multibar linkage 100 can include a fixed pivot 47 which is positioned on the fixed base 20. A movable pivot 49 extends from the fixed pivot 47 and is positioned to be guided in an arcuate cut-out groove 49A on the fixed base 20. Between the fixed pivot 47 and the movable pivot 49, a further movable pivot 50 can be positioned which extends to a further movable pivot 51 positioned on the movable dial 35. A bar 200 extends between the fixed pivot 47 and the movable pivot 49 and rotates about the fixed pivot 47 along an arcuate path defined by the cut-out groove 49A. Since the device can be hand-held, a length of the portion of the bar 200 between the fixed pivot 47 and the movable pivot 49 can be, for example, about 0.638 inches, and a length of the portion of the bar 200 between the movable pivot 50 and the movable pivot 49 can be, for example, about 0.562 inches.

The movable pivot 51 is positioned on the aiming line 39 of the movable dial 35 with the aiming line 39 leading to a further fixed pivot 53 which is coaxial with the common rotational axis 37 of the movable dial 35 and the fixed base 20. A bar 300 extends between the movable pivot 50 and the movable pivot 51. The bar 300 can have a length of, for example, about 1.072 inches. Extending from the fixed pivot 53 and a further movable pivot 55 is a pointer 57. The movable pivot 55 can be movably positioned within a further arcuate cut-out groove 60 on the fixed base 20 which guides the movement of the movable pivot 55. A bar 400 having a length of, for example, about 1.237 inches connects the movable pivot 55 to the movable pivot 49. A bar 500 which extends between the movable pivot 55 and the fixed pivot 53 can have a length of, for example about 1.20 inches. The pointer 57 extends sufficiently from the bar 500 to provide an indication on scale 41 shown on FIG. 3. Of course, the dimensions for the bars are based on the use of the device as a hand-held device, and are given for illustration purposes. It is recognized that the dimensions of the device and the bars are based on design considerations.

Through the utilization of the multibar linkage 100 as illustrated in FIG. 4, a movement of the movable dial 35 in either direction as illustrated by the arrow 62 will cause a movement of the pointer 57 about the fixed pivot 53 with the movement being guided by the cut-out grooves 49A and 60 on the fixed base 20. The cut-out grooves 49A and 60 on the fixed base 20 also facilitate the placement of part of the multibar linkage 100 above the fixed base 20, while the remainder is located below the fixed base 20, so as to eliminate the possibility of mechanical interference among the various members of the multibar linkage 100. The present invention illustrates the utilization of a multibar linkage 100 as shown in FIG. 4, however, other connection mechanisms such as gear means which can achieve the requisite movement of the pointer 57 can be utilized.

Referring to FIG. 5, an example of operation of the training device of the present invention is illustrated. As noted above, FIG. 5 illustrates the movable dial 35 rotatably mounted on the fixed base 20. During operation, the user places the semicircular cut-out 21 on the table under the intended object ball, and aligns the arrow 25 with the object ball's intended direction of travel. The user then rotates the movable dial 35 about the axis 37 to align the aiming line 39 with the direction of a cue ball as seen from the object ball's position. This sets the cut angle for a contemplated shot. In the example illustrated in FIG. 5, it is assumed that the cue ball is positioned at a cut angle of approximately 40 degrees with respect to the intended direction 25 of the object ball. That is, once the movable dial 35 is positioned as in FIG. 5 so as to align the aiming line 39 with the direction of the cue ball, when the aiming line 39 is read with respect to the scale 17 on the fixed base 20, the aiming line 39 will be positioned at a cut angle of approximately 40 degrees on the scale 17. The cut angle is the angle between the intended direction of movement 25 of the object ball and the aiming line 39 of the movable dial.

In the position illustrated in FIG. 5, the circular outline 45 on the movable dial 35 indicates that approximately 1.0 tip widths of outside english are required to negate a collision induced english. That is, both the semi-circular portion 45A and the circular outline 45 have the diameter of a cue tip. Therefore, since the shaped dark portion 29 of the fixed scale 20 completely covers the semi-circular portion 45*a* of the movable dial 35 in the position illustrated in FIG. 5, approximately 1.0 tip widths will be needed to negate collision induced english. The more that the circular portion 45 and the semi-circular portion 45A are covered by the shaped dark portion 29, the less english is needed. The portion of symbols 45 and 45A that are visible to the user consequently correspond to the amount of english required for a given shot.

The aiming line 39 of the movable dial 35 in the position illustrated in FIG. 5 also illustrates that an aim point for the cue ball is approximately 0.6 tip widths on the scale 31 of the fixed base 20 to an outside of the edge of the object ball schematically defined by the shaded portion 21A. This aim point is also graphically illustrated as the closest distance between the aiming line 39 and the edge of the object ball 21A. The circular target member 70 in FIG. 5 illustrates a convenient target for the cue ball.

As further illustrated in the position shown in FIG. 5, the movable dial 35 has been rotated to a position in which the cue ball covers slightly less than ⅜ of the object ball. This measurement is shown by the line 42B on the movable dial 35 when measured against the scale 19 on the fixed base 20. The eclipse or coverage of the object ball by the cue ball is also graphically illustrated in FIG. 5 by the amount that the circle 42A on the movable dial overlaps the shaped dark portion 27 on the fixed base 20. Finally, the line 57 in FIG. 5 represents the pointer of the multibar linkage 100 illustrated in FIG. 4. In the position of FIG. 5, the pointer 57 illustrates that the cue ball will deflect approximately 34 degrees to the left of its original path (i.e., of the aiming line 39) after hitting the object ball, assuming that the cue ball is rolling normally at the time of collision. This is the carom angle.

With respect to the carom angle or the amount that the cue ball will deflect after it collides with the object ball, it is noted that when the cut angle is set at zero degrees, the carom angle will also be zero degrees. As the cut angle increases from zero to approximately 30 degrees, the carom angle will increase to approximately 37 degrees. As the cut angle increases from 30 degrees to 90 degrees, the carom angle will decrease from 37 degrees to zero degrees. The specific arrangement of the multibar linkage 100 as illustrated in FIG. 4 will cause this movement of the pointer 57.

The relationships between the above noted scales and measurements are illustrated in the graphs of FIG. 6, in which all angles are measured in degrees relative to the fixed scale. Note that the cue ball departure angle illustrated in FIG. 6 is the sum of the carom angle $\alpha$ and the cut angle $\beta$, or equivalently is the angle between arrow 7 and arrow 9 in FIG. 1.

It may further be noted that, in the event that the cue ball 1 is sliding (i.e., not rolling) at the instant of contact with the object ball 5, then the cue ball's departure angle is 90 degrees, regardless of the cut angle provided that the cut angle is not 0 degrees. In this case, the angle between the arrow 7 and the arrow 9 is a right angle. The cue ball's post-collision path in this case is indicated by the line 80 on the fixed base 20.

As noted in *The Science of Pocket Billiards* by Jack H. Koehler, Sportology Publications (1986), the carom angle and the cut angle can be experimentally determined based on the rotation of the cue ball at the impact of the cue ball with the object ball. In the graphs illustrated in FIG. 6, the graphs on the left side representing the outside english necessary to negate collision induced english versus the cut angle, and the cue ball departure angle versus the cut angle are calculated dimensions which are experimentally determined. The graphs on the right side with respect to the eclipse fraction versus the cut angle and the aim point from the object ball edge versus the cut angle are calculated using known trigonometric and geometric relationships.

Therefore, with the device of the present invention, once the cut angle has been set, the training device simultaneously and automatically displays the cue ball's carom angle under normal roll conditions, both graphically and in degrees; the cue ball's departure direction under conditions of sliding contact; the eclipse of the object ball by the cue ball, both graphically and in eighths; the aim point of the center of the cue ball with respect to the edge of the object ball, both graphically and in units of tip widths; and the amount of outside english required (in units of cue tip widths) to negate the effect of collision induced english.

Alternatively, the user can rotate the same movable dial to set any of these other quantities. With that quantity set, the face of the training device displays all the remaining quantities simultaneously and automatically. The fixed base 20 encompasses a range of cut angles between 0 and 90 degrees. To accommodate negative cut angles, the entire training device may be inverted. All scales are labelled identically on the reverse.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A mechanical analog apparatus for cue games, the computer comprising:

means for aligning a fixed arrow with an object ball so as to set and display the object ball's intended direction of travel;

means for setting an aiming line of a cue ball based on a position of the object ball with respect to a cue ball;

means for determining a cut angle between the object ball's intended direction of travel and the aiming line;

means for determining a carom angle of the cue ball after it hits the object ball, the carom angle being defined between the aiming line and a direction in which the cue ball travels after it hits the object ball; and means for measuring a distance from a vertical axis of a cue-ball to determine a location where the cue-ball is to be hit with a cue stick.

2. The apparatus according to claim 1, further comprising:

means for determining a fraction of the object ball that is eclipsed by the cue ball.

3. The apparatus according to claim 1, further comprising means for determining an aim point of a center of the cue ball with respect to an edge of the object ball in units of tip widths of a cue stick.

4. A cue game training apparatus comprising:

a fixed base and a movable dial rotatably mounted to the fixed base so as to rotate relative to the fixed base around a common axis in parallel planes; and linking means extending between said fixed base and said movable dial, said linking means comprising a pointer such that a movement of the movable dial with respect to the fixed base causes the linking means to control a movement of the pointer relative to the fixed base and the movable dial;

wherein said linking means is a multibar linkage having a first fixed pivot on said fixed base, a second fixed pivot at said common axis, and a plurality of movable pivots between said first and second fixed pivots, said pointer rotating about said second fixed pivot and one of said movable pivots when the movable dial is rotated.

5. A training apparatus according to claim 4, wherein said fixed base comprises a cut-out portion and a fixed arrow displayed at the cut-out portion, such that the fixed arrow displays an intended direction of travel of an object ball when the cut-out portion of the fixed base is positioned under the object ball.

6. A training apparatus according to claim 5, wherein said fixed base comprises a directional line at a right angle to said fixed arrow, such that said directional line indicates the path of the cue ball after hitting the object ball and when the cue ball is sliding and not rolling at the instant of collision with the object ball.

7. A training apparatus according to claim 5, wherein said movable dial comprises an aiming line such that when said cut-out portion is positioned under the object ball, said movable dial is rotated to align said aiming line with a direction of a cue ball with respect to the object's ball position.

8. A training apparatus according to claim 7, wherein said fixed scale comprises a cut angle scale for determining a cut angle between the intended direction of travel of the object ball and the aiming line when the aiming line is aligned with the cue ball direction.

9. A training apparatus according to claim 7, wherein the movable dial comprises a carom angle scale, such that when the movable dial is rotated to align the aiming line with the direction of the cue ball, the linking means moves the pointer to a position on the carom angle scale to display a carom angle of the cue ball after the cue ball hits the object ball, said carom angle being defined between the aiming line and the pointer, such that the pointer displays a direction that the cue ball travels after it hits the object ball, assuming normal rolling conditions obtain at the instant of collision.

10. A training apparatus according to claim 8, wherein said fixed base and said movable dial comprise means for determining and displaying a fraction of the object ball that is eclipsed by the cue ball when the movable dial is rotated to align the aiming line with the direction of the cue ball.

11. A training apparatus according to claim 7, wherein said fixed base and said movable dial comprise means for measuring a distance from a vertical axis of a cue-ball to determine a location where the cue-ball is to be hit with a cue stick when the movable dial is rotated to align the aiming line with the direction of the cue ball.

12. A training apparatus according to claim 7, wherein said fixed base comprises a cue stick tip width scale, such that a position of said aiming line on said cue tip width scale defines an aim point for the cue ball with respect to an edge of the object ball in units of tip widths of a cue stick, said aim point being determined by said position of the aiming line on said cue stick tip width scale when said movable dial is rotated to align said aiming line with the cue ball direction.

13. A training apparatus according to claim 7, wherein said fixed base and said movable dial are transparent.

14. A training apparatus according to claim 7, wherein said fixed base and said movable dial carry markings that may be read from either side of said device.

15. A training apparatus according to claim 7, wherein said multibar linkage is located partly above the plane of said fixed base and partly below the plane of said fixed base, the connection between these parts being effected by means of said movable pivots guided by arcuate cut-out grooves in said fixed base.

16. A cue game training apparatus comprising:

a fixed base and a movable dial rotatably mounted on the fixed base so as to rotate relative to the fixed base around a common axis in parallel planes, said fixed base comprising a cut-out portion; and linking means extending between said fixed base and said movable dial, said linking means comprising a pointer such that a movement of the movable dial with respect to the fixed base causes the linking means to control a movement of the pointer relative to the fixed base and the movable dial;

wherein:

said movable dial comprises an aiming line such that when said cut-out portion is position under an object ball, said movable dial is rotated to align said aiming line with a direction of a cue ball with respect to the object's ball position; and said fixed base and said movable dial comprise means for measuring a distance from a vertical axis of a cue-ball to determine a location where the cue-ball is to be hit by a cue stick when the movable dial is rotated to align the aiming line with the direction of the cue ball.

17. A cue game training apparatus comprising:

a fixed base and a movable dial rotatably mounted on the fixed base so as to rotate relative to the fixed base around a common axis in parallel planes, said fixed base comprising a cut-out portion; and linking means extending between said fixed base and said movable dial, said linking means comprising a pointer such that a movement of the movable dial with respect to the fixed base causes the linking means to control a movement of the pointer relative to the fixed base and the movable dial;

wherein:

said movable dial comprises an aiming line such that when said cut-out portion is positioned under an object ball, said movable dial is rotated to align said aiming line with a direction of a cue ball with respect to the object's ball position; and said fixed base comprises a cue stick tip width scale, such that a position of said aiming line on said cue stick tip width scale defines an aim point for the cue ball with respect to an edge of the object ball in units of tip widths of a cue stick, said aim point being determined by said position of the aiming line on said cue stick tip width scale when said movable dial is rotated to align said aiming line with the cue ball direction.

18. A cue game training apparatus comprising:

a fixed base and a movable dial rotatably mounted to the fixed base so as to rotate relative to the fixed base around a common axis in parallel planes; and linking means extending between said fixed base and said movable dial, said linking means comprising a pointer such that a movement of the movable dial with respect to the fixed base causes the linking means to control a movement of the pointer relative to the fixed base and the movable dial;

wherein said fixed base and said movable dial carry markings that may be read from either side of the apparatus.

19. A mechanical analog apparatus for cue games, the computer comprising:

means for aligning a fixed arrow with an object ball so as to set and display the object ball's intended direction of travel;

means for setting an aiming line of a cue ball based on a position of the object ball with respect to a cue ball;

means for determining a cut angle of between −90 degrees to 90 degrees between the object ball's intended direction of travel and the aiming line; and means for determining a carom angle of the cue ball after it hits the object ball based on said determined cut angle, the carom angle being defined between the aiming line and a direction in which the cue ball travels after it hits the object ball.

* * * * *